United States Patent [19]

Li

[11] 4,323,395

[45] Apr. 6, 1982

[54] POWDER METALLURGY PROCESS AND PRODUCT

[76] Inventor: Chou H. Li, 379 Elm Dr., Roslyn, N.Y. 11576

[21] Appl. No.: 147,711

[22] Filed: May 8, 1980

[51] Int. Cl.[3] ..... B22F 1/00; B22F 3/00

[52] U.S. Cl. ..... 75/212

[58] Field of Search ..... 75/212

[56] References Cited

U.S. PATENT DOCUMENTS 3,838,982 10/1974 Sanderow et al. ..... 75/212
4,011,077 3/1977 Kaufman ..... 75/212
4,050,933 9/1977 Sanderow et al. ..... 75/212
4,060,414 11/1977 Kaufman ..... 75/212
4,129,443 12/1978 Kaufman ..... 75/212

*Primary Examiner*—Brooks H. Hunt

[57] ABSTRACT

The improved powder metallurgy (P/M) process for making a P/M product having a multi-component alloy system of a given composition comprises collecting powder particles of the base metal and forming on the surface of these particles a coating containing the alloying elements to a thickness calculated to provide the given composition in the finished product. The forming step is accomplished with a pure solution of a chemical compound of the alloying elements.

18 Claims, 2 Drawing Figures

POWDER METALLURGY PROCESS AND PRODUCT

FIELD

This invention relates to P/M process and products; and more particularly to improved P/M processes wherein particulate segregation due to various causes is minimized or eliminated.

PRIOR ART

P/M products are precise, versatile, and yet low in costs. They offer special porosity, density, dampling, wear, and other properties. Many products can only be made by P/M processes. As a result, P/M methods are becoming widely and, more importantly, increasingly widely, used in the auto, electronic, aerospace, medical, consumer, and other industries.

Still, there are serious problems in P/M methods that deserve attention. Among these serious problems is the segregation of the powder particles during preparation, storage, mixing, handling, and processing due to gravity, powder shape and size factors. Such segregation arises because the powder particles of different or even the same type often differ in material specific gravity (high vs low), density (high vs low, due to differing porosities, i.e., solid vs porous), shape (round, cube, flake, vs irregular) and size (large vs small). Metal elements vary from C, Be, Ca, Li, Mg, P, Rb, Si, Na (with specific densities of 2.22, 1.82, 1.55, 0.53, 1.74, 1.82, 1.52, 2.33, 0.97, respectively), through Sb, Bi, Cr, Co, Cu, Fe, Mn, Mo, Ni (with specific gravities of 6.62, 9.80, 7.19, 8.96, 8.96, 7.87, 7.43, 10.2, 8.90), to Au, Ir, Pt, Re, W, U (with specific gravities of 19.32, 22.5, 21.45, 20.0, 19.3, 18.7, respectively). Heavier particles sink faster than lighter ones. In an iron alloy containing both Al or Mg and W, e.g., the W particles are over 7 and 11 times heavier, respectively, than the Al and Mg particles, and thus tend to settle to the bottom. Many particles have face-centered, body-centered, or hexagonal crystalline structures (e.g., Al, Fe, C, Ni), while other particles have more complex structures (such as complex cubic Mn and face-centered orthorhombic S). Each structure tends to break into powder particles of unique shape, e.g., cubic into cubes and hexagonal often into flakes. Ductile particles also tend to become flattened into discs or sheets while brittle particles into nearly rounded particles. Cubes (rounded or not) settle much faster than flakes in a fluid (gas or liquid) carrying medium. Also, certain particles are tough and strong and often come in large sizes, while other particles are much smaller because of their fragility or special methods of manufacture. Large particles tend to stay on the bottom portion of a powder mix, everything else being equal.

Chu, in U.S. Pat. No. 3,737,301, used 13.2 w/o particles of −100-mesh $MoO_3$, 42.5 w/o lignin binder, and 44.3 w/o water to form a slurry to achieve a 1 w/o Mo-Fe alloy. Parikh in U.S. Pat. No. 3,424,572 mixed low alloy Fe powders with ($H_2$) reducible chemical compounds, e.g., oxides such as $Fe_3O_4$, $Fe_2O_3$, NiO, $MnO_2$, MnO, and $MoO_3$, in calculated proportions to prepare Mn, Ni, or Mo steels.

In these and other such methods, the additional alloying elements, such as Chu's Mo, are chemical compounds in the form of solid particles, which are suspended in a binder-water medium. Different chemical compounds still have differences, though usually smaller differences, in densities, porosities, shapes, sizes, and still give rise to segregation. The difference between compound particles and metal particles still is often very large. For example, with W particles mixed with oxide particles (sp. gr. maybe 2.5), the density ratio still exceeds 7.7 times. If the W is in oxide form, the density difference is much reduced. Unfortunately, in the subsequent (hydrogen) reduction step, there is so much more oxygen which is combined with W that has to be handled, raising the final P/M product cost because of the more production equipment, longer processing time, more energy consumption, and more difficulties in dissipating the products of reduction without fracturing the P/M products.

The use of oxide or other compounds for the base metal particles, and also for the alloying elements in separate particles form, also lowers the packing density but increases the compact porosity, and thus harmfully affects the strength of the finished P/M products.

Accordingly, an object of the present invention is to provide improved P/M processes and products;

A further object of this invention is to provide improved P/M processes so that the effect of powder segregation due to gravity, shape, and size factors are minimized;

A broad object of the invention is to provide improved P/M processes which can easily be controlled and automated;

A further object of the invention is to provide P/M products having improved quality, uniformity, density, and strength;

A still further object of the invention is to provide P/M processes to minimize particles segregation due to differences in particles porosity, material density, shape, and size;

Another object of the invention is to provide simple, low-cost P/M processes and products.

SUMMARY

To these ends, the present invention provides a processes for coating the surface of the base metal particles with one or more layers of the alloying element or elements, preferably with chemical solutions of these alloying elements so as to eliminate particles or alloy elements segregation regardless of the particle porosity, material densities, shapes, and sizes.

BRIEF DESCRIPTION

The invention and its further objects and features will be more clearly understood from the following detailed description taken in conjunction with the drawing in which.

DETAILED DESCRIPTION

It will be understood that the specific embodiments described are merely illustrative of the general principles of the invention and that various modifications are feasible without departing from the spirit and scope of the invention. That is, the invented method is of general applicability for increasing the quality, uniformity, and yield, but lowering the cost of the finished P/M products.

Figure 1:
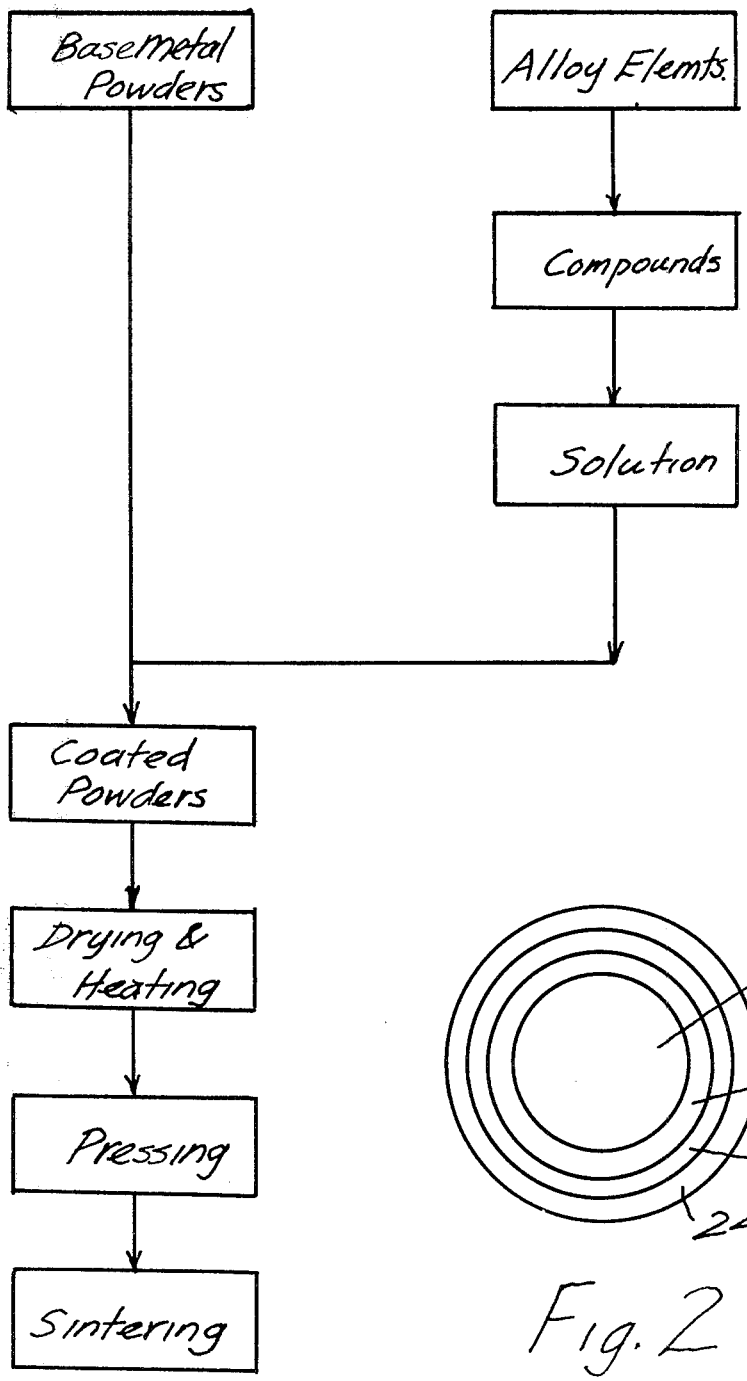
FIG. 1 is a flow diagram of the improved P/M process.
Figure 2:
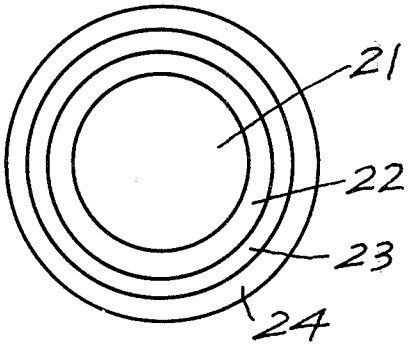
FIG. 2 is a cross-sectional view of a coated particle of the improved P/M process.

With reference to FIG. 1, to produce a Mo-Fe alloy P/M product as an example, iron powder particles of any porosity, material density, shape, or size are first collected. A pure chemical solution of a Mo compound is also prepared. The solution may contain a wetting agent, such as a commercial "Wisk" detergent, to promote wetting of the solution onto the powder surfaces. $MoO_3$, for example, is soluble in water slightly, the solubility increasing with the water temperature and the addition of $NH_4OH$ to the solution. Krey shows in U.S. Pat. No. 3,215,555 that W, Mo, or mixed W/Mo oxides may be made into an aqueous solution having an alkali metal cation and an anion such as $CO_3^{=}$, $HCO_3^{-}$, $OH^{-}$ in amounts sufficient to form dimetalates, i.e., the dimolybdates or ditungstates of the cation. Subsequent heating to 700°-800° C. (above the melting point of the metal compounds) after air drying at 100° C. for 15 minutes produces a more even distribution over the surface.

Similarly, other metal or non-metal compounds may be in solution forms. Many nitrates of metals are very soluble in cold or hot water, as well as alcohol or acetone. Such nitrates include: $Ni(NO_3)_2.6H_2O$ (molecular weight 290.8 containing 20.2 w/o Ni), $Mn(NO_3)_2.6H_2O$(mol. wt. 287.04 contg. 19.1 w/o Ni), $Cr(NO_3)_2.9H_2O$(mol. wt. 400.18 contg. 26.0 w/o Cr), $Cu(NO_3)_2.3H_2O$(mol. wt. 241,63 contg. 26.3 w/o Cu, and $Fe(NO_3)_3.6H_2O$(mol wt. 349.97 contg. 16.0 w/o Fe). The chlorides of Co, Al, and Ti are also soluble in water. Even some oxides, such as $MoO_3$, $WO_3$, and $V_2O_5$ are soluble, with or without the addition of other anions. All these compounds can be prepared into aqueous or other solutions, individually or in mixed form, for coating the base metal particles according to this invention.

The coating may be formed by dipping, following by (filtering and) drying. Several layers of coatings of the same alloying element may be used to increase the coating thickness up to 10% of the particle radius and, hence, the alloy concentration in the finished P/M products. Several layers of coatings 22-24-and 21 of different alloying elements (e.g., Ni, Cr, Mo, for Fe) may also be applied onto the same base metal (Fe) particles 22-24-21 to achieve multiple alloying results. Multiple alloying can also be achieved with a single but mixed solution containing the required alloying elements.

It is usually desirable to cover the entire surface of the base metal particles. Often, covering a major (i.e., over 50%) of the particle surface is sufficient, particularly when $MoO_3$, $WO_3$, or mixed $MoO_3/WO_3$ coatings are used followed by heating to melt and spread the compounds. Even if the coating does not completely cover the entire particle surface or spread thereon, elemental interdiffusions during the sintering step effectively homogenize sufficiently the alloy composition to produce useful P/M products.

Notice that the inner metal particles are ductile while the outer coatings containing the compounds of the alloying elements are fragile and easily fractured of fragmented under deformation. During the pressing or compressing step when the powder particles are compacted into powder compact, the inner yieldable base metal particles yield and deform under the compacting pressure into a compact of higher packing density and less porosity than the powder pack before the pressing step. Simultaneously, the surface coatings containing the alloying elements deform and fracture or fragment into tiny pieces to fill the nearly microscopic (i.e., less than 0.1 mm) voids between the pressed base metal particles, thereby further enhancing the packing density of the powder compact. Such increased density allows intimate contact between the alloying elements so essential to uniform sintering diffusion within short time.

The coatings integrally attach themselves to the base metal powder particles and are inseparable therefrom. Hence, there can be no segregation whatsoever, at least no substantive segregation, of the alloying elements during all subsequent processing steps. This non-segregating behavior does not depend on the particles porosity, material density, shape, and size. Ductile metal particles such as of Fe, Al, Mg, Ni, Cu, Ag, and Au or Zn are equally useful.

The invention, as described above, is not to be construed as limited to the particular forms disclosed herein, since these are to be regarded as illustrative rather than restrictive. For example, alcohol, acetone, benzene, and other solvents may be used to prepare the chemical solution instead of water. Even suspensions may be used. The last coating or the outmost layer may be a stearate of Al, Mg, Pb, Zn, Ca, . . . so that the coating not only provides alloying elements but also lubricates. Also, the base metal may be replaced by compounds e.g., oxides, of the base metal. All these modifications still achieve all, or at least some, of the benefits and advantages of the invention. Further, various combinations, equivalent substitutions, or other modifications of the preferred embodiments described are obviously possible in light of the description, without departing from the spirit and scope of the invention. Accordingly, the invention is to be limited only as indicated by the scope of the following appended claims:

I claim:

1. A method for making a powder metallurgy product having a multi-component alloy system of a given composition comprising:

collecting powder particles containing a selected component;

forming on the surface of the powder particles a coating containing the other component to a thickness calculated to provide the given composition in the finished product, the specific gravity of the selected component differing from that of the other component by at least a factor of two;

pressing said collected and coated particles to form a powder compact; and sintering the powder compact.

2. A method as in claim 1 wherein the collecting step comprises collecting powder particles consisting essentially of the selected component.

3. A method as in claim 2 wherein the selected component is an iron alloy while the other component is selected from the group consisting of Ni, Co, Cr, Mo, W, V, Ti, Cu, Al, Si, Mn, C, P, and S; and the forming step comprises forming the coating from a pure chemical solution of an inorganic compound of the other component.

4. A method as in claim 1 wherein the selected component is yieldable while the coating is fracturable under deformation; and including packing the coated particles into a powder pack; and pressing or compressing the powder pack into a powder compact, during the pressing step the inner, yieldable selected component yielding under the pressing forces into a compact of higher packing density and less porosity while simultaneously deforming the surface coating of the other component into fragmentated pieces to fill the nearby porosities or voids between the pressed powder particles thereby further enhancing the packing density of the powder compact.

5. A method as in claim 1 wherein the coating comprises a chemical compound of the other component.

6. A method as in claim 1 wherein the forming step comprises forming a coating from a liquid having the other component suspended therein, and including the additional steps of applying the suspension onto the surface of the powder particles and drying out the liquid from the surface of the powder particles to thereby form the coating containing the other component.

7. A method for making a powder metallurgy product having a multi-component system of a given composition comprising:

collecting powder particles consisting essentially of a selected, yieldable component;

forming on the surface of the particles a coating containing the other component and having a thickness calculated to provide the given composition in the finished product, said coating being fracturable and fragmentable under deformation;

pressing said collected and coated particles, during said pressing step said particles yielding and deforming under the compacting pressure while, simultaneously, said coating fracturing and fragmenting into pieces to fill the nearby voids between said pressed particles thereby enhancing the packing density of the powder compact;

and sintering the pressed powder compact.

8. A method as in claim 1 or 7 wherein the forming step forms the coating which uniformly covers substantially the entire surface of the powder particles.

9. The product of the method as in claim 8 characterized by the substantially uniform coating of the other component over substantially the entire surface of the powder particles of the selected component, the coating being integrally attached to the powder particles so as to prevent, during subsequent processing steps, segregation of components due to powder porosity, material density, shape, and size factors.

10. A method as in claim 7 wherein the specific gravity of the selected component differs from that of the other component by at least by a factor of two.

11. A method as in claim 7 or 1 wherein said coating consists essentially of a stearate of a metal selected from the group consisting of Al, Mg, Pb, Zn, and Ca, said stearate both acting as a powder lubricant and providing the other component.

12. A method as in claim 1 or 7 wherein said forming step partially covers the surface of the particles with the coating; and including heating and fusing said partially covering coating to spread it uniformly over the surface of the particles.

13. A method as in claim 1 or 7 wherein said forming step comprises coating with a solution of a compound of the other component in a solvent, said solvent being selected from the group consisting of water, alcohol, acetone, and benzene.

14. A method as in claim 13 wherein said solution is an aqueous solution containing an oxide of a material selected from the group consisting of tungsten and molybdenum; an alkali metal cation; and an anion selected from the group consisting of $CO_3^{=}$, $HCO_3^{-}$, and $OH^{-}$ in amounts sufficient to form dimetalates.

15. A method as in claim 1 or 7 wherein said forming step comprises coating to a thickness exceeding 10% of the radius of the particles.

16. A method as in claim 7 or 1 wherein said forming step comprises applying a plurality of coating layers of different alloying elements onto the particles to achieve multiple alloying results.

17. A method as in claim 1 or 7 wherein said forming step comprises applying a single, mixed solution containing a plurality of alloying elements.

18. A method as in claim 7 or 1 wherein said selected element consists essentially of a metal selected from the group consisting of Fe, Al, Mg, Ni, Cu, Ag, Au and Zn.

* * * * *